United States Patent [19]

Swengel Jr. et al.

[11] Patent Number: 4,878,863

[45] Date of Patent: Nov. 7, 1989

[54] ELECTRICAL CONNECTOR AND CONTACT TERMINAL THEREFOR

[75] Inventors: Robert C. Swengel Jr., York; James H. Wise, Palmyra, both of Pa.

[73] Assignee: AMP Incorporated, Harrisburg, Pa.

[21] Appl. No.: 288,748

[22] Filed: Dec. 22, 1988

[51] Int. Cl.[4] ..... H01R 13/52

[52] U.S. Cl. ..... 439/884

[58] Field of Search ..... 439/271-276, 439/816, 819, 825, 884

[56] References Cited

U.S. PATENT DOCUMENTS

| | | | |
|---|---|---|---|
| 2,978,667 | 4/1961 | Watts . | |
| 3,281,763 | 10/1966 | Crowley et al. . | |
| 3,372,476 | 3/1968 | Peiffer et al. . | |
| 3,453,587 | 7/1969 | Neidecker . | |
| 3,879,097 | 4/1975 | Pertle | 439/271 |
| 4,039,238 | 8/1977 | Johnson Jr. et al. . | |

FOREIGN PATENT DOCUMENTS

| | | |
|---|---|---|
| 0283767 | 9/1988 | European Pat. Off. . |
| 0283768 | 9/1988 | European Pat. Off. . |

OTHER PUBLICATIONS

AMP Product Bulletin No. 161.

AMP IS Sheets 1854 and 7027.

*Primary Examiner*—Joseph H. McGlynn

*Attorney, Agent, or Firm*—Katherine A. Nelson

[57] ABSTRACT

The present invention is directed to a connector assembly 20 comprising a pin terminal member 24 having a forward portion 26 including contact means therearound defining a frustoconical contact surface, a complimentary socket terminal member 72 including contact means and housing means that assures assembly of respective said pin and socket terminal members 24, 72 as they are moved axially together and electrical engagement of respective contact surfaces 30, 78 thereof upon full mating of said terminal members 24, 72. The surface of the pin terminal member 24 has an array of facets 28 disposed in selected areas therealong, the outer surface portions defining a plurality of contact areas 30. The socket member 72 includes a forward portion having a frustoconical contact surface defining a cavity 76 adapted to receive the forward section 26 of the pin terminal member 24. The housing means includes first and second insert members 52, 82 in which the pin and socket terminal members 24, 72 are disposed and first and second sleeve members 42, 98 coupleable together to assure engagement of the terminal members 24, 72.

23 Claims, 7 Drawing Sheets

ELECTRICAL CONNECTOR AND CONTACT TERMINAL THEREFOR

FIELD OF THE INVENTION

This invention relates to the field of electrical contact terminals, and more particularly to tapered pin and socket terminals.

BACKGROUND OF THE INVENTION

In order to have a reliable electrical connection between electrical contact terminal members such as pin and socket terminals, it is necessary to have at least one and preferably a plurality of contact points or lines between the pin and socket terminal members. This is particularly important for electrical terminal members used to carry power, wherein it is desirable to have multiple contact points between the mating terminal members to provide an equalized flow of current therethrough. In order to get an equalized current path, it is desirable that as many of the contact points as possible be in parallel.

One way of achieving a plurality of parallel points is by using members having a number of compliant beams or independent spring fingers. U.S. patent application Ser. No. 07/091,973 discloses one type of power contact terminal pair wherein the female terminal member includes a plurality of cantilevered beams received in a solid receptacle member, thus providing a plurality of contact points between the two terminal members when they are mated. U.S. Pat. Nos. 3,453,587; and 4,039,238 disclose connector assemblies in which a strip of interconnected contact springs is disposed in a tubular array around the peripheral surface of one of the mating terminal members to provide a plurality of contact points between the members.

Another type terminal assembly that assures electrical contact between mated members is a tapered pin and receptacle assembly members such as those disclosed in U.S. Pat. Nos. 3,281,763; and 3,372,476 owned by the present assignee, wherein a solid pin terminal includes a tapered forward contact surface that engages and is wedged against a complimentary surface within a taper pin receptacle. The advantage of a taper pin is that it has a low value of constriction resistance when the contact is mated. To ensure electrical engagement, tapered terminals are typically designed to "self lock" upon application of sufficient force. A tool and application of force are therefore required to disengage the locked members. Furthermore, the presence of dust in the tapered area can reduce the efficiency of the contact and prevent self locking.

It is desirable therefore, particularly in power connection to provide a terminal assembly that will have a low resistance and multiple contact points. It is also desirable that the connection be readily separable and not lock itself together.

High quality electrical engagement is critical particularly in power conducting terminal connections and is dependent not only on high contact force but also on the use of conductive materials such as copper and copper alloys. One problem associated with the highly conductive materials and load demands placed on power contacts is that there is generally a 20 to 30 degree rise in temperature when the contact is placed under load. Since a rise in temperature will cause the materials of the two contact members to expand and try to move axially apart. To retain continuity of the circuit path it is necessary to provide means wherein the pin and socket members remain securely engaged and have electrical contact in the multiple contact points. Typically this means included use of a "self-locking" taper or a pre-loaded spring member, that is a heavy duty spring member, which provides considerable force against a member of the assembly.

SUMMARY OF THE INVENTION

Accordingly, to alleviate the disadvantages and deficiencies of the prior art, the present invention is directed to an electrical terminal assembly having means that provides a plurality of contact points between complimentary mating surfaces.

It is an object of the present invention to provide a reliable electrical terminal assembly for use in power systems.

It is a further object of the invention to provide a plurality of parallel current paths through the electrical terminal assembly wherein the current paths are equalized.

It is another object of the invention to provide a separable multiterminal electrical connector assembly for power connections.

It is yet another object of the invention to provide a plurality of current paths through the terminal assembly using a minimum of elements in the assembly.

Another object of the invention is to provide an electrical contact terminal assembly for power connections wherein the resistance remains low throughout the life of the power system.

It is also an object of the invention to provide a separable connector having a plurality of mating pairs of complimentary tapered terminal members wherein the mated terminal members have a low resistance under current load, yet be separable without means of a tool to force the members apart.

It is an additional object of the invention to provide a means for minimizing the influence of dust between the engaged surface portions of the mated terminal members.

Furthermore, it is an object of the present invention to provide an electrical terminal assembly wherein the mating pin and socket members have frustoconical mating surfaces that will essentially self lock when subjected to load, but be separable when the load is removed.

It is an further object of the present invention to provide an electrical terminal assembly wherein the mating pin and socket members have tapered mating surfaces having a plurality of contact points between their respective mating surfaces.

For purposes of this invention, the term "facets" means "a plurality of projections extending from the mating surface of an electrical terminal member having a portion of the surface area in contact with the contact surface of a complimentary terminal member" and the term "macrocontactasperities" or "macroasperities" defines "those portions of the interfacial contact surfaces between respective facets of one terminal member and the complimentary contact surface of a mated terminal member that are in actual physical engagement and with each other at any one time." The size of the macroasperities is variable in that upon an increase in normal force and the expansion of the terminals under load, the amount of surface area actually in physical contact between the two mated members increases.

In accordance with the invention an electrical terminal assembly comprises a pin contact member and a complimentary mating socket member. The pin and socket members have respective forward portions including respective contact means therearound defining respective complimentary tapered surfaces, the tapered surface of the socket member defining a cavity for receiving the forward portion of the pin member. The tapered surface of one of the terminal members includes an array of projections or facets extending from the mating surface thereof disposed in selected areas along the corresponding forward portion. The outer surfaces of the projections define a plurality of contact areas. Upon mating of the pin and socket members and urging the pin and socket members together, the plurality of pin terminal contact areas provide a multitude of macrocontactasperities between the respective tapered surfaces to establish a plurality of essentially parallel circuit paths for current passing through the mated members.

The present invention further includes a connector assembly having means for providing increased normal force and therefore lower constriction resistance between the mated terminal members of the connector during or as terminal members are subjected to a load in a system. The increase in force is provided by using materials in the connector assembly that have different rates of thermal expansion, that is the material used for at least one of the members exhibits a greater amount of expansion per degree of temperature change than the material used for another member. In the preferred embodiment the outer housing of the connector is made from stainless steel and the terminal members of copper. As load is placed on the system, the amount of expansion per degree of temperature change is greater in the copper terminal members than in the stainless steel housing members. The stainless steel outer housing therefore, acts as a restraining member to prevent the radially outward expansion of the pin and socket members and the inner housing members and spring member limit expansion axially rearwardly. The pin and socket members are thereby forced to expand essentially in an axial direction, which applies a greater normal force between the interfacial surface between the pin terminal contact areas and inner surfaces of the socket cavity increasing the relative size of the macrocontactasperities and decreases the resistance through the terminal members. As a further aspect of the invention, one of the terminal members may be made from a material that will expand to a greater amount per degree rise in temperature than the material used for the other member.

The present invention provides a connector assembly wherein the electrical terminal assembly surprising and unexpectedly exhibit a lower resistance after operating under current load than when first subjected to current load.

It is also to be understood that the contact assembly of the present invention may be used with other housing members and other means for providing assured electrical connection may be incorporated therein.

In the preferred embodiment of the invention, the tapered pin terminal member includes frustoconical portion and the array of projections or facets is disposed on the surface of the frustoconical portion. The forward portion of the pin member is adapted to be received in a complimentary frustoconical cavity in mating socket member. Upon mating of the pin and socket member and urging the pin and socket members together, the plurality of contact areas on the pin terminal member provide a multitude of macrocontactasperities between the surface of the facets and the cavity surface to establish a plurality of essentially parallel circuit paths for current passing through the mated members.

The invention itself, together with further objects and its intended advantages, will be best understood by reference to the following detailed description taken in conjunction with the accompanying drawings.

DETAILED DESCRIPTION OF THE DRAWINGS

Figure 1:
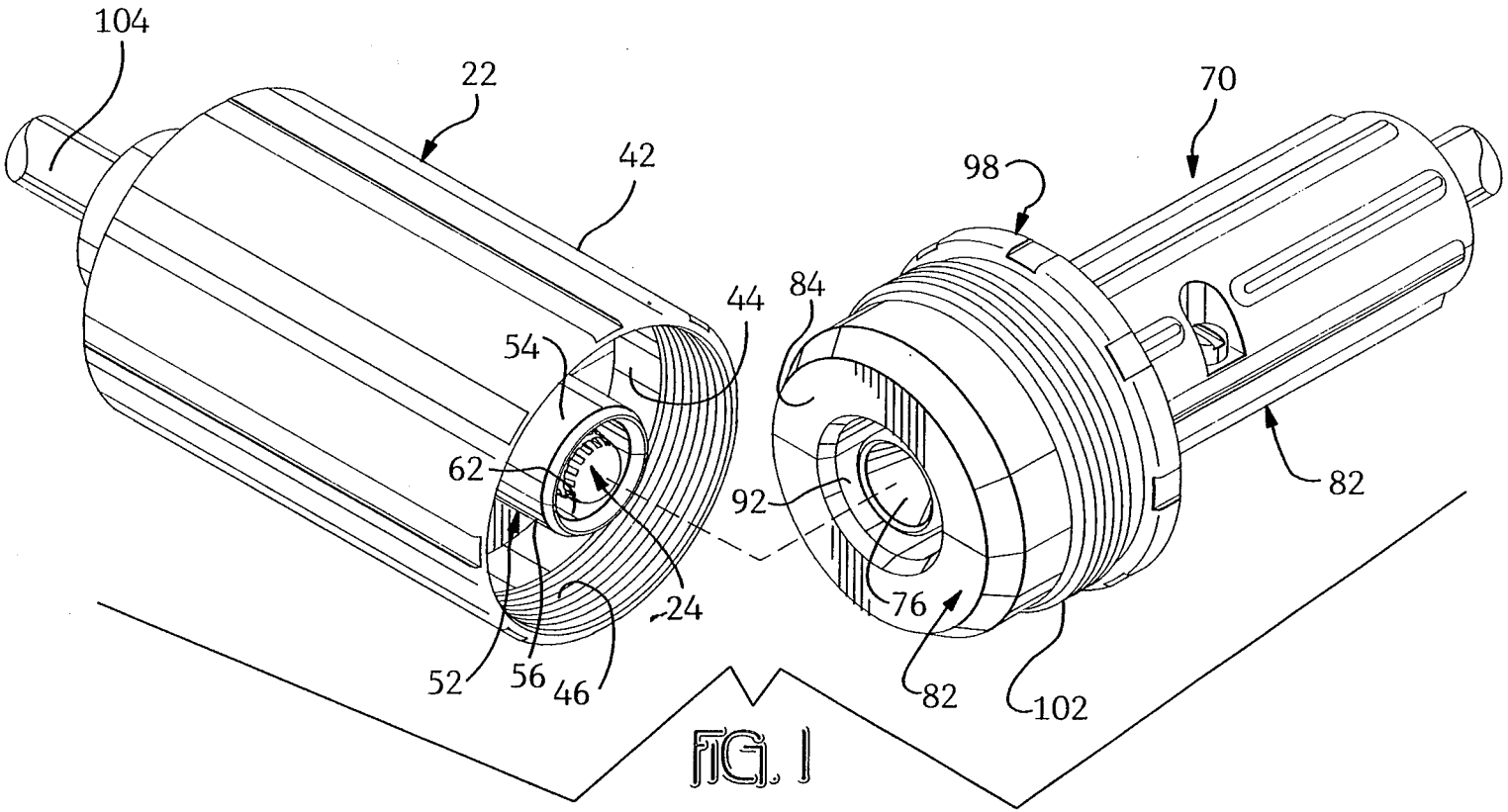
FIG. 1 is an exploded perspective view of a connector having receptacle and plug members made in accordance with the present invention.
Figure 2:
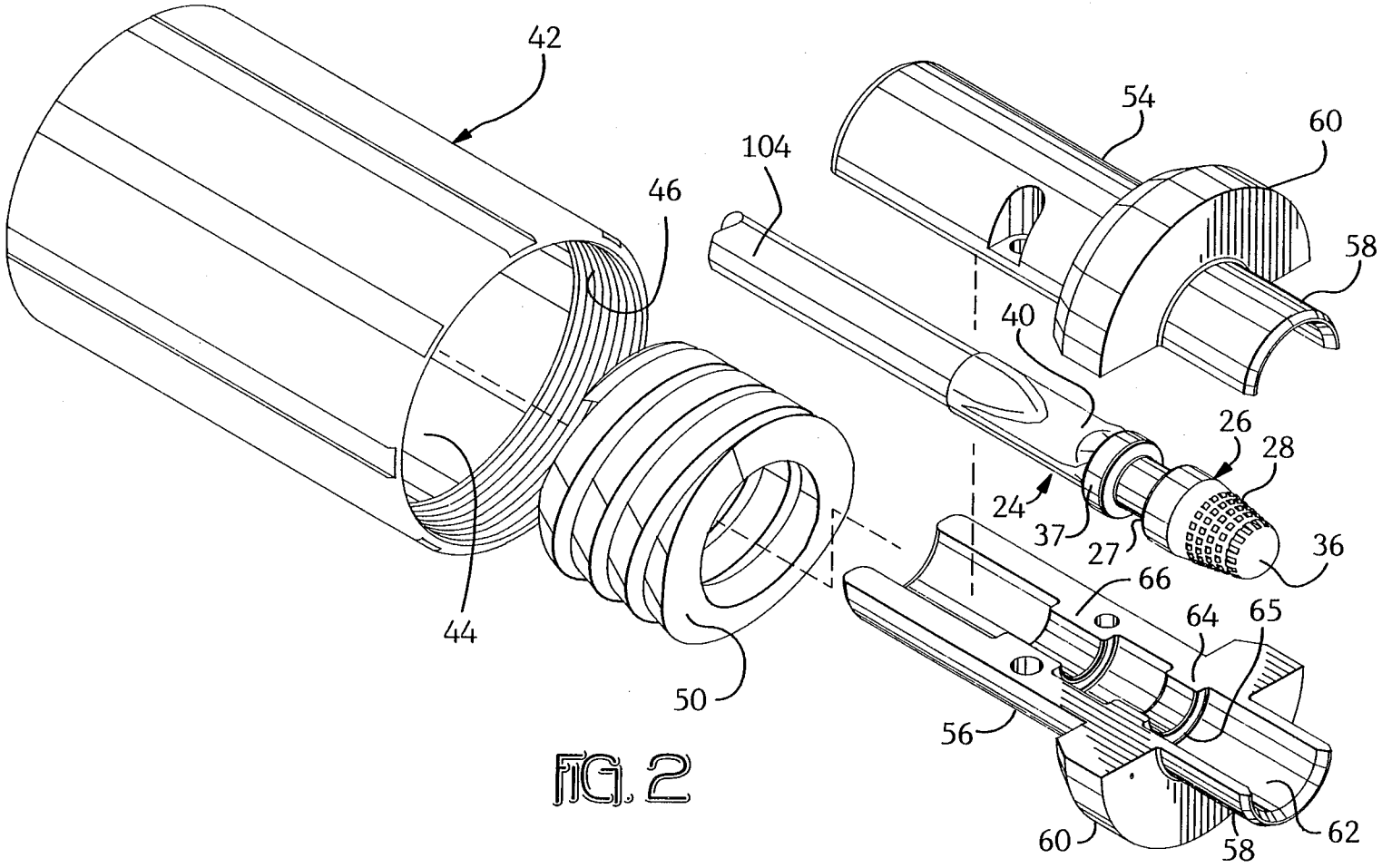
FIG. 2 is an exploded perspective view of the receptacle member of FIG. 1, the receptacle member having the pin terminal member of the present invention disposed therein.
Figure 3:
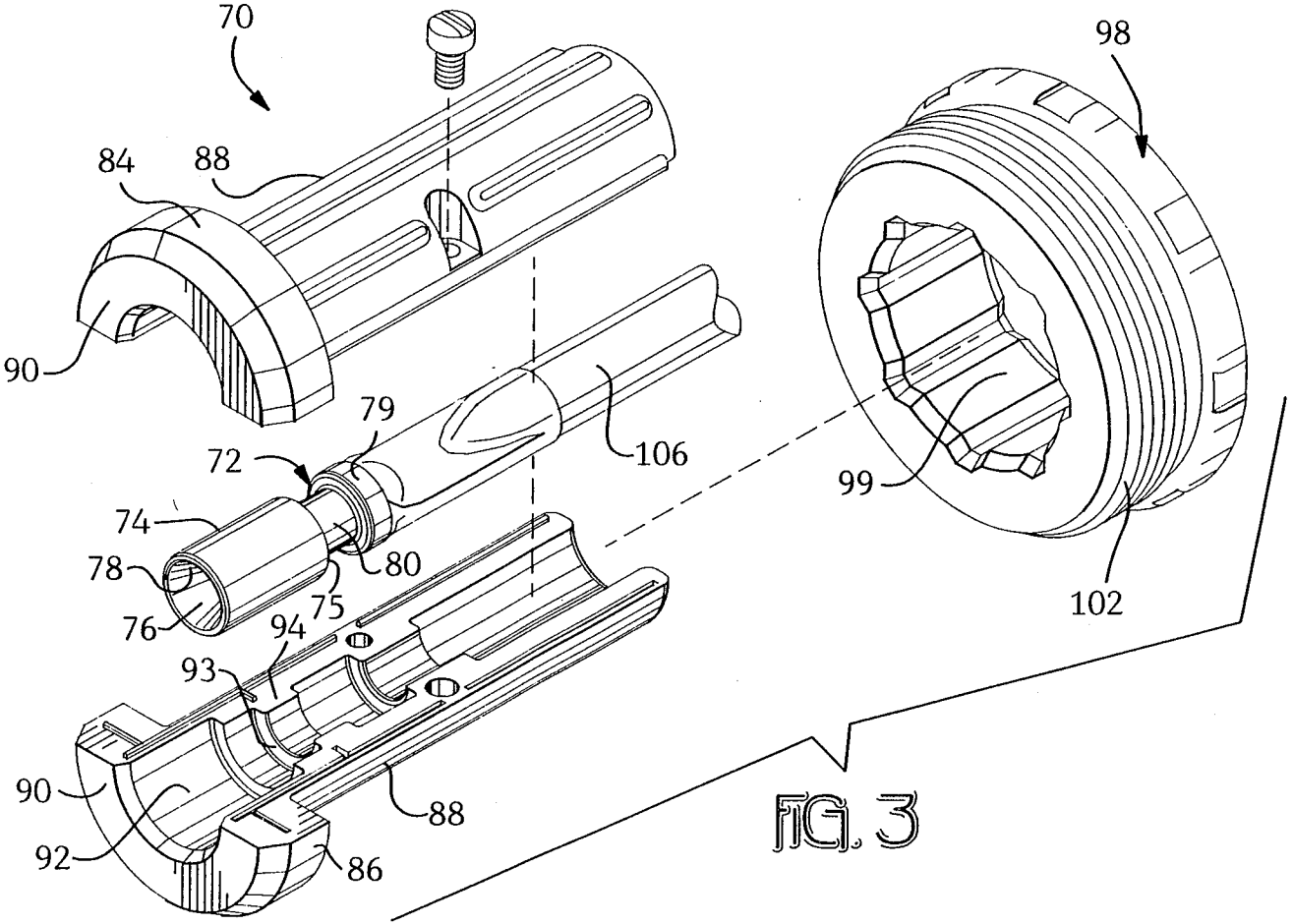
FIG. 3 is an exploded perspective view of the plug member of FIG. 1, the plug member having the receptacle of the present invention therein.
Figure 4:
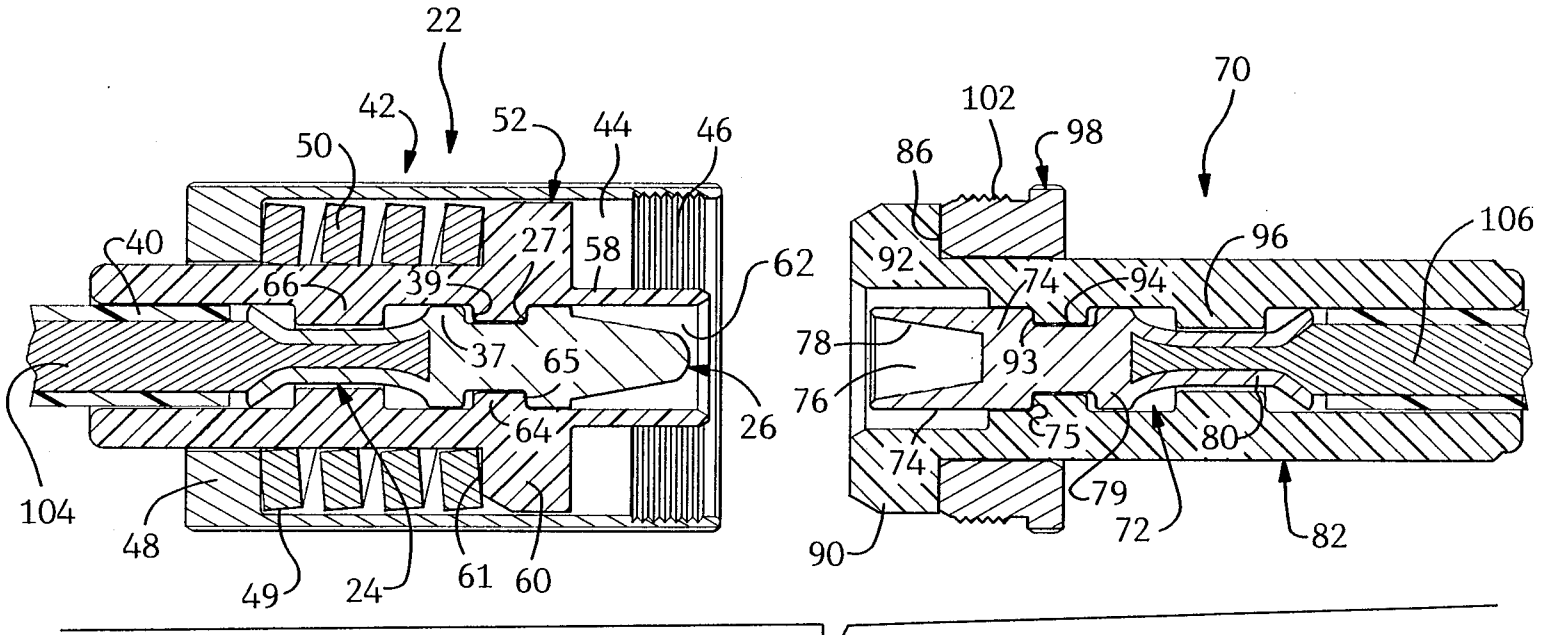
FIG. 4 is a cross sectional view of the assembled plug and receptacle members of FIGS. 2 and 3.
Figure 5:
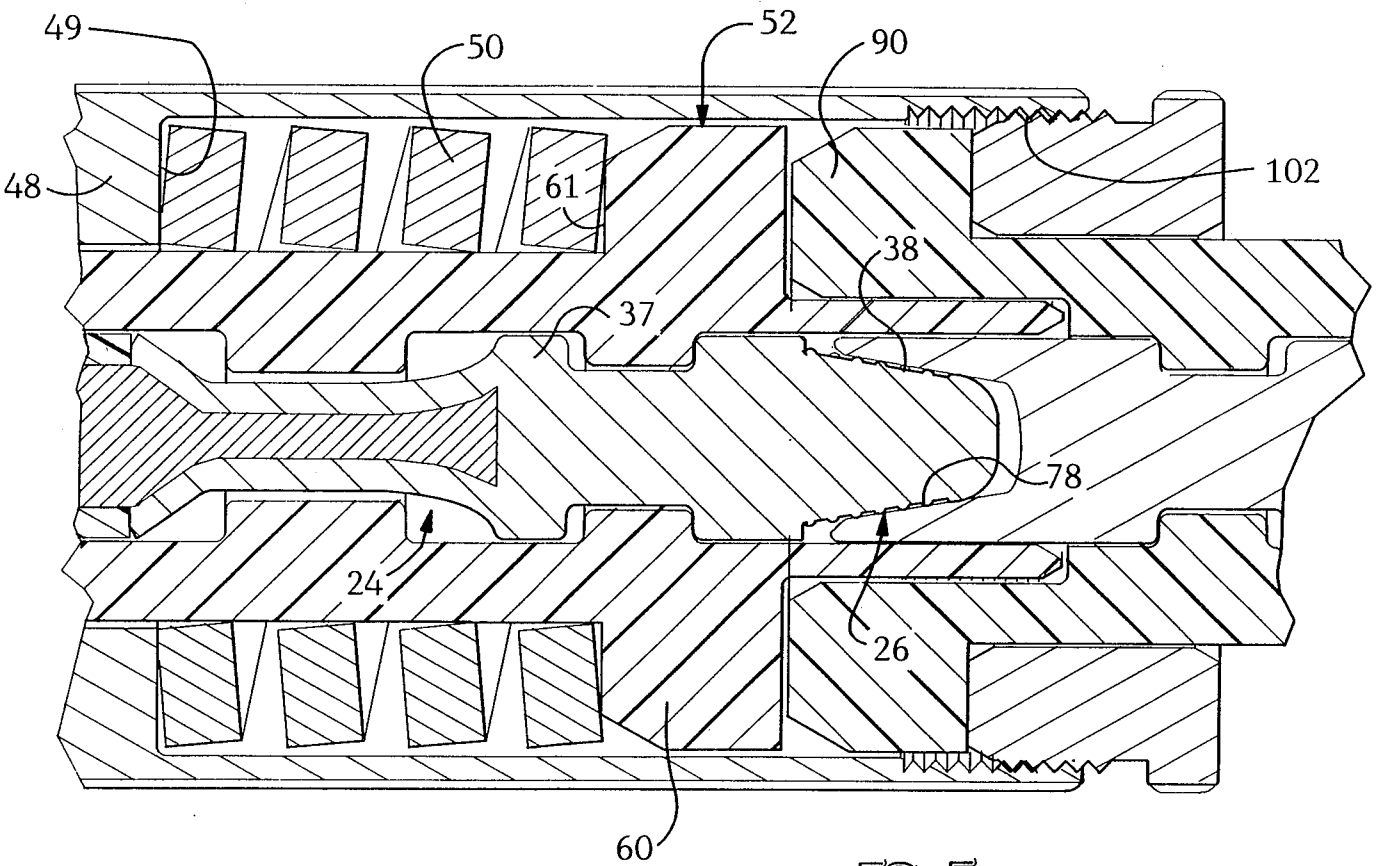
FIG. 5 is a fragmentary cross sectional view of the mated connector assembly of FIG. 4.
Figure 6:
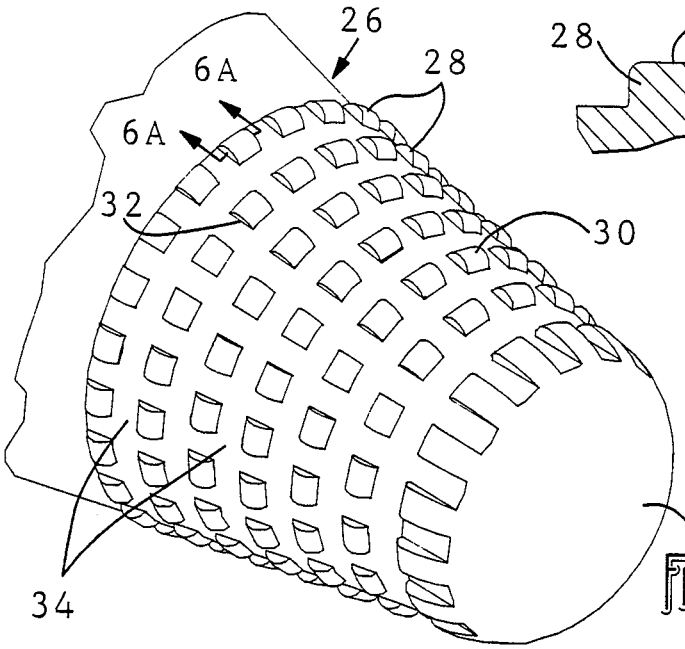
FIG. 6 is an enlarged fragmentary view of a forward portion of the pin terminal member of the present invention.
Figure 6A:
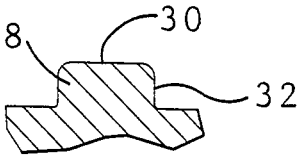
FIG. 6A is an enlarged cross sectional view taken along line 6A—6A of FIG. 6.

Referring now to FIGS. 1 through 6A, connector 20 comprises receptacle member 22 and plug member 70 respectively as shown in FIGS. 4 and 5. The construction of receptacle member 22 is best seen by referring to FIGS. 2, 4 and 5. Receptacle member 22 includes pin contact terminal member 24, first or outer housing 42 and a second or inner housing 52. Pin terminal member 24 comprises a forward portion 26 having a generally frustoconical surface with an array of facets 28 disposed in selected areas therealong, and rearward portion 40. Forward portion 26 has a surface of revolution that extends substantially and preferably entirely circumferentially continuously therearound. As best seen in FIGS. 6 and 6A, facets 28 comprise an array of outwardly extending, radially disposed projections having sides 32 and contact surface areas 30 on the upper surface thereof, the facets 28 having spaces 34 therebetween. Generally tip 36 of the forward pin contact portion 26 does not include facets, since the tip does not engage the internal surfaces of a corresponding receptacle member. Rearward portion 40 of contact member 24 includes outwardly extending flange 37 for cooperating with a housing member as described more fully below. As shown in FIGS. 2, 4 and 5, pin terminal member 24 is secured to conductor wire member 104.

First or outer receptacle housing member 42 has a passageway 44 extending therethrough for receiving second housing means 52, as shown in FIGS. 4 and 5. Passageway 44 includes threaded portion 46 on a forward end thereof and an inwardly directed angular flange 48 at the rearward end thereof. Spring member 50 is disposed at the rearward end of aperture 44 proximate inward directed flange 48, the forward surface of which provides a stop surface 49 for spring member 50. Inner or second receptacle housing member 52 includes two dielectric portions 54, 56, which together define passageway 62 for receiving pin contact member 24 therein. Housing member 52 is profiled to be slidably received in aperture 44 of housing 42. Second receptacle housing 52 further includes forward section 58 having a flange 60. Passageway 62 of housing member 52 includes radially, inwardly extending flanges 64, 66 which cooperate with radially, outwardly extending flange 37 of terminal 24 to secure pin terminal member 24 in housing 52.

In the assembled inner housing member 52, forward surface 65 of flange 64 abuts the rearward surface 27 of forward portion 26 of pin terminal member 24. Flanges 37 and 41 of pin terminal member 24 lie in passageway portions between flanges 64 and 66 and rearward of flange 66 respectively. In the assembled receptacle member 22, flange 60 of housing 52 is dimensioned to be received in outer receptacle housing 42 and passageway 44 is dimensioned to receive forward portion 58 of inner housing member 52, as best seen in FIGS. 4 and 5.

FIGS. 3, 4, and 5, illustrate the construction of plug member 70. Plug member 70 includes socket contact terminal member 72, housing member 82 and ring member 98. Socket terminal member 72 includes forward portion 74 and rearward portion 80. Forward portion 74 includes a cavity 76 with a tapered inner surface 78 extending thereinto, cavity 76 being a generally frustoconical cavity profiled to receive forward portion 26 of pin terminal member 24 therein. Rearward portion 80 includes outwardly extending flange 79 for cooperating with a housing member as described more fully below. Socket terminal member 72 is terminated to wire member 106 as shown in FIGS. 3, 4 and 5.

Housing member 82 includes two dielectric portions 84, 86, which together define passageway 92 for receiving socket terminal member 72 therein. Housing member 82 includes forward section 88 having a flange 90. Passageway 92 of housing member 82 includes radially, inwardly extending flanges 94, 96, which cooperate with radially, outwardly extending flange 79 of socket terminal member 72, to secure socket terminal member 72 in housing 82. In the assembled housing 82, forward surface 93 of flange 94 abuts the rearward surface 75 of socket forward portion 74. Flange 90 of housing 82 is dimensioned to be received in outer receptacle housing 42 and passageway 92 is dimensioned to receive forward portion 58 of inward housing member 52 with forward pin terminal portion 26 extending into tapered passageway 78 of socket terminal member 72 as best seen in FIG. 5. Ring member 98 having aperture 99 extending there through is disposed on the outer surface of housing member 82 and includes corresponding outwardly threaded members 102 for engaging inward threaded aperture 46 of outer receptacle housing 42 for securing the plug and receptacle members 22, 70 as shown in FIG. 5.

In mating the connector of the present assembly, the contact terminal members 24, 72 are first engaged and after which the locking ring 98 is moved forward on the plug member 70 to engage a threaded portion of the receptacle and the housing members 22, 70 are secured together with a forward face of ring 98 abutting rearward face 98 of flange 90 as seen in FIG. 5. As the locking ring is tightened a load is applied to the spring 50, which in turn exerts force on inner receptacle housing 52 to take up tolerances and to force the two terminal members 24, 72 together.

Figure 7A:
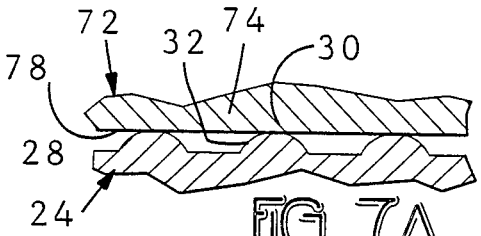
FIG. 7A is an enlarged fragmentary cross sectional view of FIG. 6 illustrating the relative size of the facets and macroasperities before current load is applied.
Figure 7B:
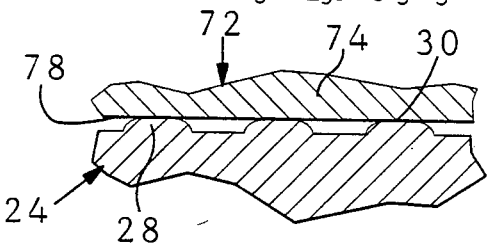
FIG. 7B is a view similar to that of FIG. 7A illustrating the relative size of the facets and macroasperities under current load.

As shown in FIGS. 5, 7A and 7B, when pin contact member 24 of receptacle member 22 is mated with socket member 72 of plug member 70, pin terminal contact areas 30 engage the inner surface 78 of socket member 72 to define a plurality of macrocontactasperities 38 between the contact areas 30 and the socket cavity surface 78. The assembly 20, thereby provides a plurality of parallel circuit paths for current passing through the mated members. Spaces 34 between adjacent facets 28 provide means for any dust to "escape" from between the engaged surfaces, thus overcoming the problems typically associated with dust and tapered contact terminals.

In accordance with the present invention, it is preferable that the angle of taper of the pin and socket members be greater than 7° to prevent self-locking upon mating the terminal members. The mated terminal members, therefore, do not require the use of a tool to force them apart. Since the terminals do not self-lock, it is necessary that the structure of the connector housings provide means for assuring the terminal members remain in good electrical contact with each other when subjected to a current load. As can be seen in FIGS. 4 and 5, terminal members 24, 72 are held in their respective housing passageways 62, 92 by means of flanges 64, 94, which abut against respective rearward faces 27, 75 of forward terminal portions 26, 74 of receptacle and plug members 22, 70 respectively. As current load is applied to the system, and the temperature through the terminal members rises, the terminal members 24, 72 are prevented from moving rearwardly by the flanges 64, 94. Under the current load, the mated terminal members of the present invention unexpectedly and surprisingly exhibit a lower constriction resistance as the temperature of the system rises.

Test results obtained on samples of mated terminals made in accordance with the invention showed that the resistance through the mated terminal members unexpectedly and surprisingly decreased during the life of the tests, rather than increased as is typically the case with prior art terminals. The tests concluded measuring the rise in temperature of mated terminal members under increasing current load in accordance with Test 5*a* of IEC 512-3 (International Electrotechnical Commission); temperature-humidity cycling of mated terminal members under a current load in accordance with MIL STD-1344, Method 1002; heat age testing of mated terminal members under a current load wherein the terminals are exposed to an elevated temperature for a desired duration of time to activate stress relaxation characteristics of the metal; vibration testing of current carrying terminals in accordance with MIL STD-1344, Method 2005 and also to current cycling testing.

It is believed the lowering of the constriction resistance occurs because the effective contact area between the mated terminal members increases under load. Since the mated terminal members, 24,70 are restrained from rearward movement by respective flanges 64, 94, it is believed they expand axially forwardly as the temperature rises thus increasing the normal force between the mated tapered members 24, 70. The increase in normal force compresses the facets and concomitantly the facets expand owing to the increase in temperature. The effective amount of surface area in physical engagement, that is, the size of the macroasperities 38 between the pin and socket terminal members along the interface therefore increase. This increase in relative size is illustrated in FIGS. 7 and 7A wherein FIG. 7 shows the surface area of the macrocontactasperities before the increase in normal force and FIG. 7A shows the relative increase in surface area after the increase in normal force under load has occurred.

While the invention has been described in terms of a single pair of mating terminal members in an individual receptacle and plug connector, it is to be understood that a plurality of pairs of terminal members may be used in multicontact connector housings. Since the terminal members are in effect "self releasing" multicontact connectors may be used to provide reliable separable interconnections without the need of tools to "tap" the terminal members into engagement or to "force" the terminal members apart.

It is to be further understood that facets may be provided on either the pin surface or inside the socket cavity. For ease of manufacturing, however, it is preferred to place facets on the pin terminal members.

Figure 9:
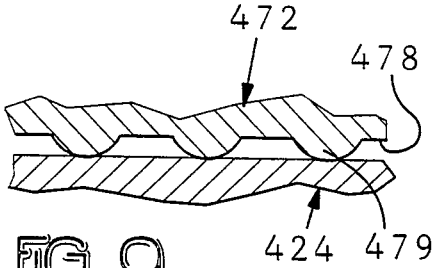
FIG. 9 is a fragmentary view of a forward portion of an alternative embodiment of a socket member made in accordance with the invention.
Figure 8C:
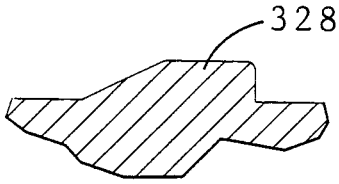
FIGS. 8A–8C are enlarged fragmentary views of forward pin terminal portions having alternative shapes for the facets.
Figure 8A:
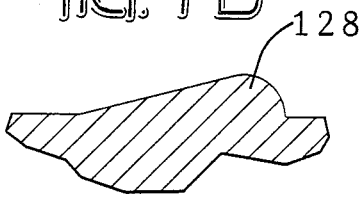
Figure 8B:
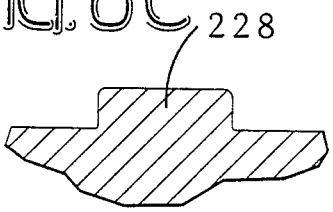

FIGS. 8A, 8B and 8C illustrate alternative embodiments 128, 228, and 328, for the shape of the facets. The shape shown in FIG. 8A provides a sloped entering surface and is suitable for placement on the interior surface of socket member 472 as shown in FIG. 9, as well as the outer surface of a pin member. Socket member 472 includes facets 479 on interior surface 478 of cavity.

Figure 10:
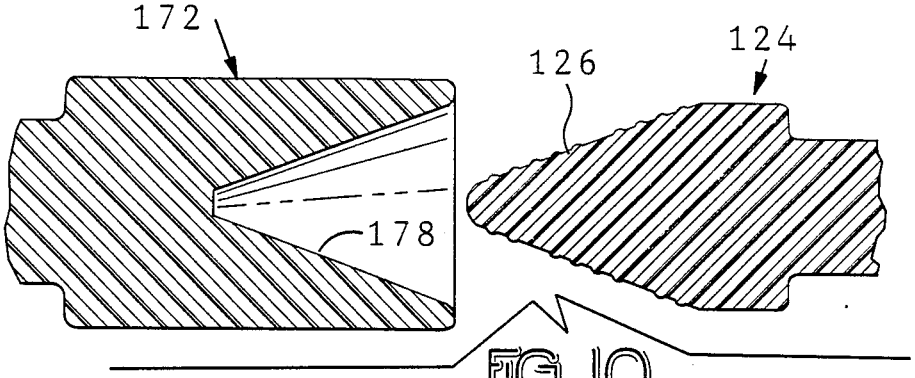
FIG. 10 is a perspective view of an alternative embodiment of the electrical terminal assembly of the present invention.

FIGS. 10 shows an alternative embodiment 124 of the pin contact terminal wherein forward portion 126 is a more pointed frustoconical member with the complimentary frustoconical surface 178 of socket terminal member 172 being adapted to receive pin terminal member 124.

In the preferred embodiment of conductor 20, pin and socket members 24, 72 are made from a conductive material, such as a copper alloy. Preferably the tapered surfaces are plated with silver or another noble metal. Additionally a suitable contact lubricant such as a polyphenylene or other material is used on the plated surfaces, as is known in the art. The facets may be made by means known in the art, such as by screw machining, cold heading or impact extrusion. Inner receptacle housing member 52 and plug housing member 82 are preferably made from dielectric material such as a glass filled polyester. In the embodiment shown, housings 52 and 82 are of the type known as "clam shell" configurations comprising hermaphroditic members that may be secured together. First or outer housing member 42 and ring or collar member 98 are metal, such as stainless steel.

The present invention further includes a connector assembly having means for providing increased normal force and therefore a lower constriction resistance between the mated terminal members of the connector during or as the terminal members are subjected to a load in a system. The increase in force is provided by using materials in the connector assembly that have different rates of thermal expansion, that is the material used for at least one of the members exhibits a greater amount of expansion per degree of temperature change than that the material used for another member. This aspect of the invention can be illustrated as follows.

In the preferred embodiment the outer housing of the connector is made from stainless steel and the terminal members of copper. As load is placed on the system, the amount of expansion per degree of temperature change is greater in the copper terminal members than in the stainless steel housing members. The stainless steel outer housing therefore, acts as a restraining member to prevent the radially outward expansion of the pin and socket members and the inner housing members and spring member limit expansion axially rearwardly. The pin and socket members are thereby forced to expand essentially in an axial direction, which applies a greater normal force between contact areas 30 and inner surfaces 78 of socket cavity 76, increases the size of the macroasperities and decreases the resistance through the terminal members. By utilizing the different rates of thermal expansion to provide the normal force, the spring member 50 needs to be of sufficient strength to provide electrical stability and to "take up" any tolerances within the system rather than providing the normal force as typically required in the prior art.

Alternatively or in addition to the above, the tapered pin terminal member is made from a material that will expand to a greater amount per degree rise in temperature than the material used for the tapered socket member. Thus, as the temperature rises under an applied load to the connector, the pin terminal member will expand to a greater amount than the complimentary socket member thus causing an increase in normal force between the mated terminal members, which will increase the amount of surface contact between the members and in turn will lower the resistance. This means that the terminal assembly can be designed to have a fairly low insertion force when first mated but as soon as it begins to get hotter and expand under a load the force exerted between the mated surfaces will increase. As a result a very reliable interconnection is achieved between the pin terminal and socket member. The initial millivolt drop across the system as a load is applied is the maximum that would occur during the operation of the connector. In order for this system to work, however, it is necessary that the plug and receptacle halves of the connector be held together securely, as previously described, so that the increased normal force between the terminal members is not sufficient to separate the plug and receptacle members.

Figure 12:
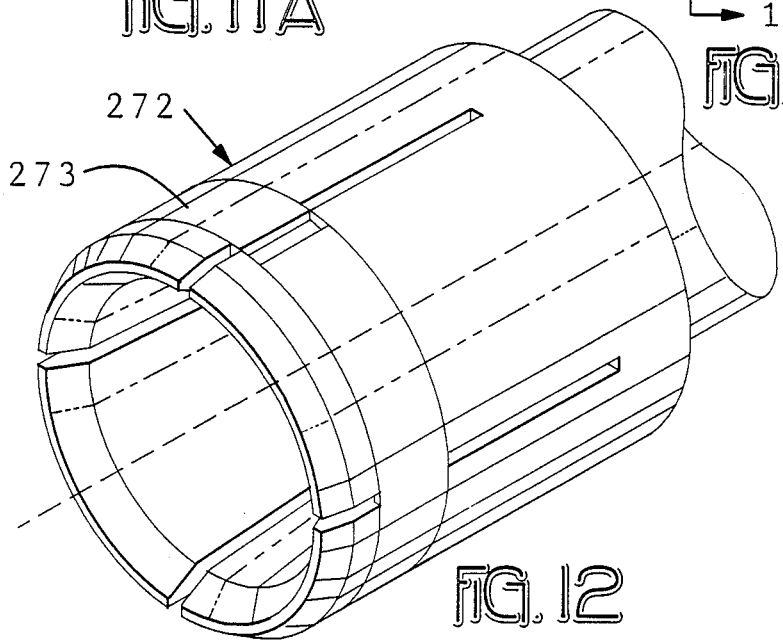
FIG. 12 is a perspective view of another alternative embodiment of the socket member of the present invention.

In making tapered pin and socket terminal members, it is necessary to control the tolerances of the progressively tapered surfaces such that they have essentially the same degree of slope and will mate at the correct depth to provide the desired interference fit. To minimize problems with tolerances in controlling the insertion depth of the pin into the socket, one of the terminal members may be segmented lengthwise to form a multiplicity of cantilever beam elements. The other complimentary member preferably should remain as a contiguous surface to allow for the non-polarized operation of the contact pair. When the pin 224 is segmented as shown in FIGS. 10 and 10A, the compliant beams 235 move inwardly as the pin member 224 is inserted into the tapered receptacle member. When the socket member 272 is segmented as shown in FIG. 12, the segments 275 move outwardly as the pin is inserted more deeply into the socket cavity. As shown in FIG. 12, socket member 272 is further provided with a ring 273 to restrain excessive outward movement of the beams. In the preferred embodiment, ring 273 is made from a material having a lower rate of thermal expansion than that of socket terminal 272. For example, ring 273 can be made of stainless steel while terminal 272 is made of copper or a copper alloy.

Figure 11A:
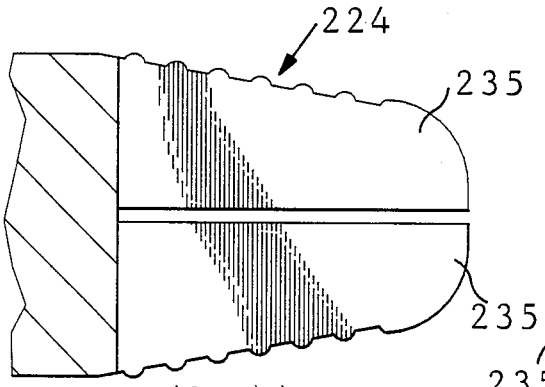
FIG. 11A is a view of pin terminal taken along line 10A—10A of FIG. 10.
Figure 11B:
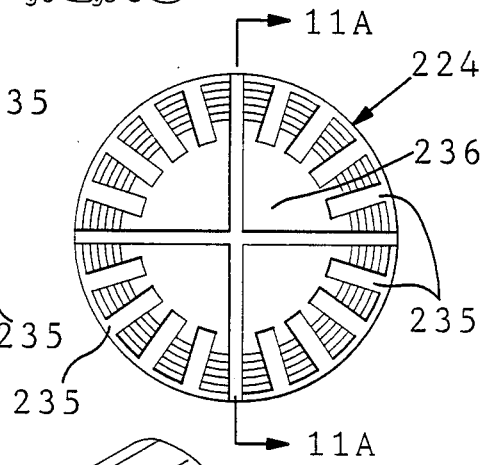
FIG. 11 is an end view of an alternative embodiment of the pin terminal of the present invention.

When segmenting either the pin or socket member, it is desirable that the taper of the members be made at two different angles to create an interference such that the compliant member has to deflect out of the way to eliminate the interference. In its final deflected state, contact surfaces 30 of the facets 28 would still make complete contact with the inner surface 78 of socket member 72. Furthermore, since some compliancy is present in the contact assembly, some normal force is generated owing to the deflecting of the cantilevered beams. Thus the amount of normal force that must be applied by a constraining member on the mated pin and socket terminal members is reduced. Either of the alternative embodiments of FIGS. 11 and 12 are particularly suitable for use with a dielectric housing member since the load compression force on the threaded couplings is reduced. It is to be understood that one or the other terminal member 224, 272 may be made from a material having a different rate of thermal expansion as previously discussed.

It is thought that the electrical contact assembly of the present invention and many of its intended advantages will be understood from the foregoing descriptions. Changes may be made in the form, construction and arrangement of part thereof without departing from the spirit and scope of the invention or sacrificing all of its materials advantages.

What is claimed is:

1. A pin terminal member for mating with a complimentary socket terminal member, said pin terminal member comprising:

a forward portion including contact means therearound defining a tapered contact surface, said surface having an array of facets disposed in selected areas along said surface, the outer surface portions of said facets defining a plurality of small contact areas;

said forward portion being adapted to conform to an complimentary inner tapered surface of a mating socket terminal member; whereby upon mating of said pin and socket terminal members and urging said pin and socket terminal members together, said facets provide a multitude of macrocontactasperities between said pin terminal contact areas and said inner socket terminal surface to establish a plurality of essentially parallel circuit paths for current passing through said mated terminal members thus decreasing the constriction resistance of the mated members.

2. The pin terminal member of claim 1 wherein said contact means extends substantially entirely and circumferentially continuously around said pin terminal member.

3. The pin terminal member of claim 1 wherein said tapered forward portion includes a plurality of slots extending axially therealong to divide said forward portion into a plurality of compliant beam contact portions.

4. An electrical terminal assembly comprising:

a pin terminal member having a forward portion including contact means therearound defining a tapered contact surface, said surface having an array of facets disposed in selected areas along said surface, the outer surface portions of said facets defining a plurality of small contact areas; and a socket terminal member having a forward portion including a tapered cavity, said cavity having contact surfaces extending therearound, said cavity being adapted to receive said tapered portion of said pin terminal member; whereby upon mating of said pin and socket terminal members and urging said pin and socket terminal members together, said facets provide a multitude of macrocontactasperities between said pin terminal contact areas and said inner socket surface to establish a plurality of essentially parallel circuit paths for current passing through said mated members thus decreasing the constriction resistance of the mated members.

5. The electrical terminal assembly of claim 4 wherein the pin and socket terminal members are made from different materials and wherein one material has a different rate of thermal expansion than the other.

6. The electrical terminal assembly of claim 4 wherein said tapered forward portion of said pin terminal member includes a plurality of slots extending axially therealong to divide said forward portion into a plurality of compliant beam portions.

7. The electrical terminal assembly of claim 4 wherein said tapered forward portion of said socket terminal member includes a plurality of slots extending axially therealong to divide said forward portion into a plurality of compliant beam portions.

8. The electrical terminal assembly of claim 7 further including a ring member disposed over said socket compliant beam portions to prevent overstressing of said beam contact portions.

9. The electrical terminal assembly of claim 8 wherein said ring member is made from a material having a lower rate of thermal expansion than the material used for said socket terminal member.

10. A connector assembly having at least one of said electrical terminal assemblies of claim 4 disposed therein.

11. A connector assembly comprising:

a pin terminal member having a forward portion including contact means therearound defining a tapered contact surface, said surface having an array of facets disposed in selected areas along said surface, the outer surface portions of said facets defining a plurality of small contact areas;

a socket terminal member having a forward portion including contact means comprising a tapered contact surface defining a cavity adapted to receive said forward section of said pin terminal member; and housing means including first and second insert members in which are disposed said pin and socket terminal members and first and second sleeve members coupleable together to assure assembly of respective said pin and socket terminal members as they are moved axially together and electrical engagement of respective contact surfaces thereof upon full mating of said terminal members; whereby upon mating of said pin and socket terminal members and urging said pin and socket terminal members together, said facets provide a multitude of macrocontactasperities between said pin terminal contact areas and said inner socket surface to establish a plurality of essentially parallel circuit paths for current passing through said mated terminal members thus decreasing the constriction resistance of the mated terminal members.

12. The electrical terminal assembly of claim 11 wherein the pin and socket terminal members are made from different materials and wherein one material has a different rate of thermal expansion than the other.

13. The electrical terminal assembly of claim 11 wherein said tapered forward portion of said pin terminal member includes a plurality of slots extending axially therealong to divide said forward portion into a plurality of compliant beam portions.

14. The electrical terminal assembly of claim 11 wherein said tapered forward portion of said socket terminal member includes a plurality of slots extending axially therealong to divide said forward portion into a plurality of compliant beam portions.

15. The electrical terminal assembly of claim 11 further including a ring member disposed over said socket compliant beam portions to prevent overstressing of said beam contact portions.

16. The electrical terminal assembly of claim 11 wherein said ring member is made from a material having a lower rate of thermal expansion than the material used for said socket terminal member.

17. The electrical connector assembly of claim 11 wherein said first and second sleeve members are made from a conductive material that has a lower rate of thermal expansion than the material used for the pin and socket terminal members.

18. A connector assembly comprising:

a male terminal member having a forward portion including contact means therearound defining a tapered contact surface;

a female terminal member having a forward section including contact means comprising a tapered contact surface defining a cavity adapted to receive said forward section of said male terminal member;

housing means including first and second insert members in which are disposed said male and female terminal members and first and second sleeve members coupleable together to assure assembly of respective said male and female terminal members as they are moved axially together and electrical engagement of respective contact surfaces thereof upon full mating of said terminal members; and means restraining said male and female terminal members at least against incremental movement of said contact surfaces axially apart upon a substantial rise in temperature.

19. The electrical connector assembly of claim 18 wherein said restraining means comprises using a conductive material for said first and second sleeve members that has a lower rate of thermal expansion than the material used for the pin and socket terminal members.

20. The electrical connector assembly of claim 18 wherein said female terminal member is made from one conductive material and said male terminal member is made from another conductive material and wherein one of said first and second materials has a lower rate of thermal expansion than the other of said first and second materials.

21. The electrical connector assembly of claim 18 wherein the tapered contact surface of one of said male and female terminal members is provided with an array of facets disposed in selected areas along said surface, the outer surface portion of said facets defining a plurality of small contact areas whereby upon mating of said male and female terminal members and urging said male and female terminal members together said contact areas provide a multitude of macrocontactasperities between said facet contact areas and the contact surface of the complimentary terminal member to establish a plurality of a essentially parallel circuit paths for current passing through said mated members thus decreasing the constriction resistance of the mated members.

22. The electrical connector assembly of claim 21 wherein the tapered contact surface of the female terminal member includes said array of facets.

23. The electrical connector assembly of claim 21 wherein the tapered contact surface of the male terminal member includes said array of facets.

* * * * *